United States Patent [19]

Balleraud

[11] Patent Number: 4,735,472

[45] Date of Patent: Apr. 5, 1988

[54] MOORING SYSTEM

[75] Inventor: Pierre Balleraud, Menton, France

[73] Assignee: Single Buoy Moorings Inc., Marly, Switzerland

[21] Appl. No.: 885,702

[22] Filed: Jul. 15, 1986

[30] Foreign Application Priority Data

Jul. 26, 1985 [NL] Netherlands ..... 8502140

[51] Int. Cl.[4] ..... B63B 22/02

[52] U.S. Cl. ..... 441/3; 114/230

[58] Field of Search ..... 441/3–5; 405/202, 203, 204; 114/264, 230; 166/350, 367; 174/42; 188/379

[56] References Cited

U.S. PATENT DOCUMENTS 3,602,174 8/1971 Gorman ..... 441/4
3,804,210 4/1974 Erickson ..... 188/379
3,978,804 9/1976 Beynet et al. ..... 114/265
4,176,986 12/1979 Taft et al. ..... 441/4

FOREIGN PATENT DOCUMENTS 0051091 5/1982 European Pat. Off. .
0087922 9/1983 European Pat. Off. .
2156407 10/1985 United Kingdom .

*Primary Examiner*—Joseph F. Peters, Jr.
*Assistant Examiner*—Jesûs D. Sotelo
*Attorney, Agent, or Firm*—Young & Thompson

[57] ABSTRACT

Mooring system comprising a column (2) tensioned between a sea bottom anchor (3) and a buoyant body (5-8) said column having (an) additional mass(es) (11,12,13,14,27) at the vibration node or nodes of the second or $(N+1)^{th}$ bending vibration node(s) above the wave period while keeping the periods of the higher modes of bending vibration below or in the area of the smaller waves.

5 Claims, 3 Drawing Sheets

MOORING SYSTEM

The invention relates to a mooring system comprising a column extending under tension between a connecting point adjacent to the sea bottom and a point located adjacent to the water level, which column has bending vibration nodes between the said points with an associated period.

Mooring systems of this type are known in many embodiments. By choosing a suitable length for this column they can be used in different water depths. Said length of the column, in combination with among others the rigidity against bending and the distribution of the masses of the column, influences the vibration behaviour of the mooring system. In combination with the periodical loads resulting from the wave movements of the sea, this behaviour is determining for the occurrence or non-occurrence of resonance.

To avoid resonance it is necessary to fulfil the requirement that the periods of the bending vibrations of the column lie outside the area of the wave periods of the sea water. In this respect mainly the lowest bending vibrations are important.

With relatively long columns the problem occurs that the lowest bending vibrations have periods which lie within the area of the wave periods. This could be avoided by dividing the column into parts which are pivotably connected with each other (vide e.g. U.S. Pat. No. 4,280,238), but in particular with greater water depths it is undesirable to provide the column with pivotable joints.

The object of the invention is to provide a mooring system having a relatively long column of one-piece construction of which the period of the lowest bending vibration or vibrations cannot generate resonance. If said period is indicated with N, in which N can be unity, then the period N+1 might be in the area of the smallest wave periods.

According to the invention this object is achieved in that an additional mass or masses respectively is or are coupled with the column at the location or locations respectively of the vibration node or nodes respectively of the N+1 bending vibrations of the column. This additional mass or masses has or have to be so calculated in relation to the length of the column and the periods of larger and smaller waves of the wave pattern to be expected at the location of the mooring system, that the period of the $N^{th}$ vibration is greater than the wave period of the large waves and the period of the higher vibrations N+1, N+2 etc. are smaller than or equal to the period of the smaller waves. Said additional mass or masses could be made from any material, e.g. concrete. They can be rigidly connected to the column or so that they can move in the longitudinal direction of the column due to which the column is not loaded by the weight of the mass. The latter can be achieved e.g. by means of annular additional mass sliding upon the column and suspended with cables from a buoyant body.

Moreover a buoy can be rigidly connected to the column. The steel mass of the buoy then forms the additional mass. Said embodiment has as additional advantage that the buoyancy of the buoy exerts a tensile fore upon the portion of the column located below the buoy.

According to a preferred embodiment the additional mass or masses is or are formed by a water mass present between the outer wall of the column and a sleeve surrounding the column and connected with the column. Said sleeve can have any shape suitable to hold the water inside it with respect to the column during displacements resulting from bending vibrations.

According to a preferred embodiment the upper and lower end of the sleeve could be in fully open connection with the surrounding water. Moreover the sleeve can be made narrower towards its outer ends. Throttle openings may be provided to generate a dampening function.

The additional mass or masses can be formed by a filling of the column, such as a local ballast mass.

Said mass can be formed by concrete or other heavy material but can be formed as well by a space to be filled with water. The outer dimensions such as the diameter of the column then need not to be changed.

Said additional mass also can be formed by and/or the present in a portion of larger outer dimensions than the dimensions of the column. By the larger outer dimensions a larger mass is already formed and larger flow resistances are generated as well, which space, if desired, further can be provided with an additional mass.

In the following the invention now will be further elucidated with reference to the drawings.

FIG. 1 schematically shows the principle of the invention where N=1.

FIGS. 2, 3 and 4 schematically show different embodiments for arranging an additional mass.

FIGS. 5, 6 and 7 schematically show different embodiments of the column upon which the measure according to the invention has been applied.

FIG. 1 shows the mooring system with reference numeral 1. It comprises a column 2 held at its lower end on the sea bottom 4 by means of a ball joint 3 and at its upper end by means of a cardan joint 5. Said cardan joint forms part of an arm 6 with buoyant body 7 connected to a tanker 8. The first bending vibration 9 and the second bending vibration 10 are schematically indicated.

FIG. 2 shows how at the level of the central vibration node of the second bending vibration a sleeve 11 has been mounted around the column 2. Between said sleeve and the column there is a water mass 12 forming the additional mass.

Figure 5:
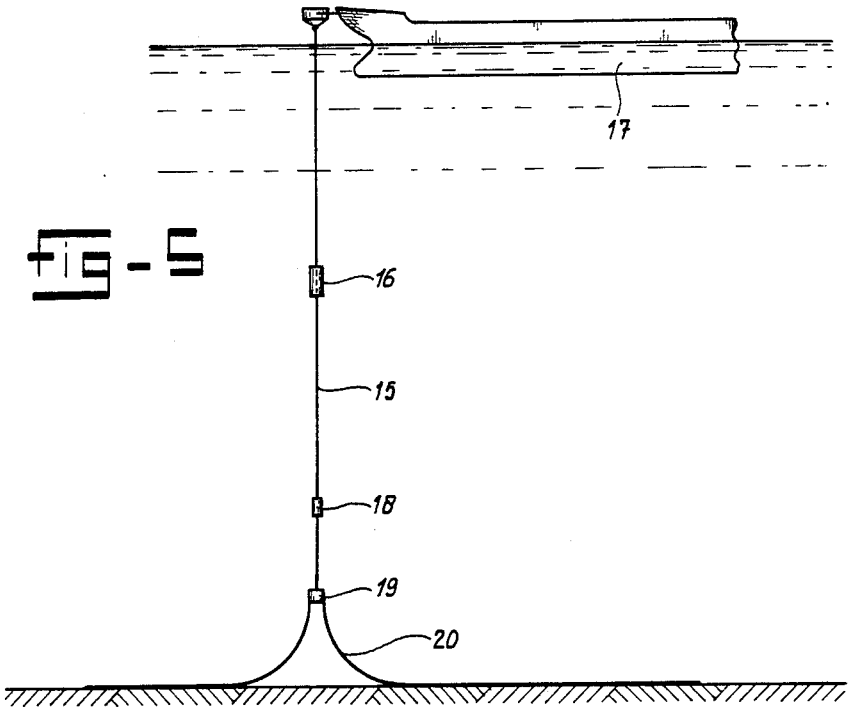

FIG. 5 shows that the column 15 with the additional mass 16 can be suspended from a vessel 17, can be loaded by a weight 18 and with its lower end 19 located adjacent to the sea bottom be anchored by means of chains 20.

With said embodiment the column is held under tension by the weight 18.

Figure 6:
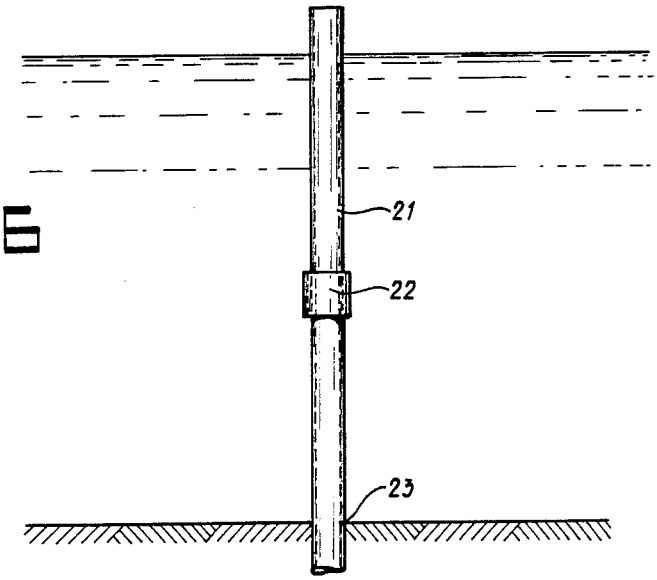

FIG. 6 schematically shows a column 21 with the additional mass 22, which column has been positioned in the sea bottom at 23. In this embodiment the column is loaded undercompression.

Figure 1:
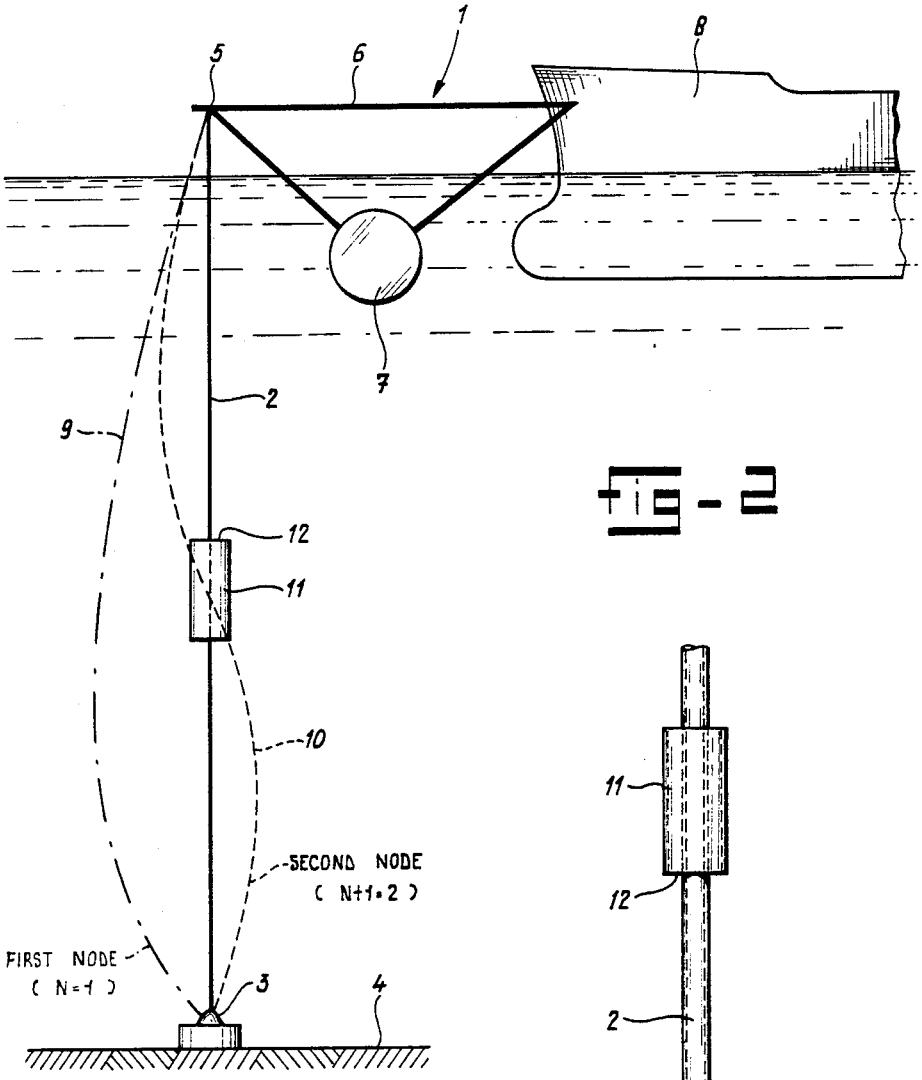
Figure 2:
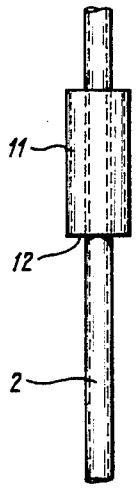
Figure 3:
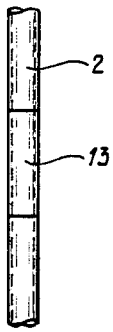
FIG. 3 shows a column provided at said location with a concrete mass 13. The diameter of the column 2 has not been changed by it.
Figure 4:
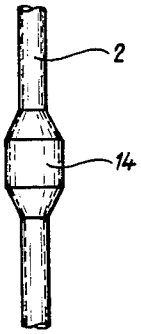
FIG. 4 shows an embodiment in which the column 2 at the location of the vibration node of the second bending vibration has been provided with a thickening 14 which may be or may be not filled with an additional mass.
Figure 7:
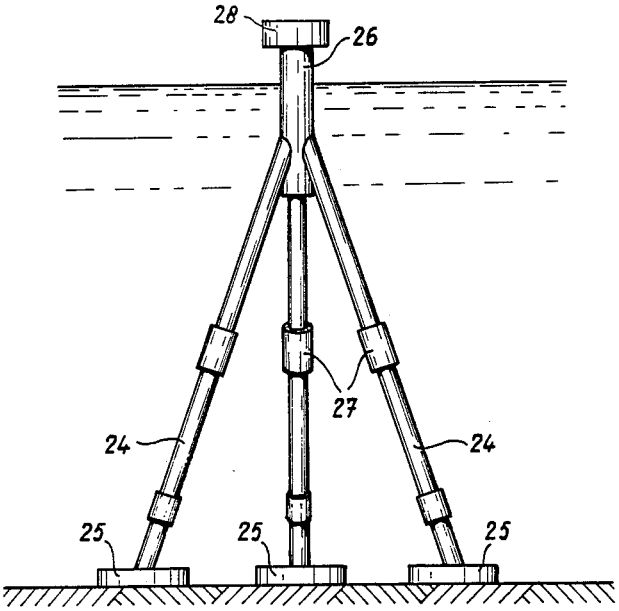

FIG. 7 shows the application of the invention with a construction comprising e.g. three supporting legs 24 which at 25 are placed upon the sea bottom and at the top are interconnected by means of a body 26 extending through the water level. Here the masses are provided at 27. With said construction the load is generallly under compression from a deckload 28.

What is claimed is:

1. In a mooring system comprising a column extending between a lower end anchored adjacent to the sea bottom and a free upper end located adjacent to the water surface, and means to moor a vessel to said free upper end, which column has a bending vibration between the said ends; the improvement comprising at least one mass in addition to the mass of the column coupled with the column at the location of at least one vibration node of the column intermediate the height of the column, so as to suppress transverse movements of the column arising from wave action adjacent said upper end of the column.

2. Structure as claimed in claim 1, in which said mass in addition to the mass of the column is a water mass present between the outer wall of the column and a sleeve surrounding the column and connected with the column.

3. Structure as claimed in claim 2, in which said sleeve is open at top and bottom to the surrounding water.

4. Structure as claimed in claim 1, in which said mass in addition to the mass of the column comprises a filling of the column only at said at least one node.

5. Structure as claimed in claim 1, in which said mass in addition to the mass of the column comprises an enlargement of the column only at said at least one node.

* * * * *